US006573807B2

(12) United States Patent
Noe

(10) Patent No.: US 6,573,807 B2
(45) Date of Patent: Jun. 3, 2003

(54) HIGH-POWER DIRECTIONAL COUPLER AND METHOD FOR FABRICATING

(75) Inventor: Terrence R. Noe, Sebastopol, CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 72 days.

(21) Appl. No.: 10/003,906

(22) Filed: Oct. 31, 2001

(65) Prior Publication Data

US 2003/0080825 A1 May 1, 2003

(51) Int. Cl.[7] ..... H01P 5/18
(52) U.S. Cl. ..... 333/116; 333/117
(58) Field of Search ..... 333/116, 117, 333/109, 113, 239, 248

(56) References Cited

U.S. PATENT DOCUMENTS 4,127,831 A * 11/1978 Riblet ..... 333/113
4,425,549 A * 1/1984 Schwartz et al. ..... 329/354
4,990,870 A * 2/1991 Reindel ..... 333/208
5,001,492 A * 3/1991 Shapiro et al. ..... 343/700 MS
5,410,179 A * 4/1995 Kornrumpf et al. ..... 257/638
6,281,769 B1 * 8/2001 Fiedziuszko ..... 333/239

* cited by examiner

*Primary Examiner*—Robert Pascal
*Assistant Examiner*—Dean Takaoka

(57) ABSTRACT

A high-power coupler formed from a substrate, such as a dielectric printed circuit board, is disclosed. The through arm and coupled arm(s) of the coupler have a conductor plated on the top, bottom and edges of the dielectric printed circuit board, completely enclosing the dielectric material in the conductor. A metal package surrounding the coupler forms the outer ground. Thin non-conductive struts of the dielectric material of the printed circuit board interconnect the separate arms of the coupler. The coupler may be integrated with microstrip circuitry, such as switches and resistors.

20 Claims, 5 Drawing Sheets

HIGH-POWER DIRECTIONAL COUPLER AND METHOD FOR FABRICATING

BACKGROUND OF THE INVENTION

1. Technical Field of the Invention

The present invention relates generally to directional couplers, and specifically to high-power directional couplers.

2. Description of Related Art

A directional coupler has a through arm through which a signal passes and at least one coupled arm that samples the signal. At a basic level, a high-power directional coupler causes a sample of an electromagnetic wave propagating on the through arm to propagate on the coupled arm. Therefore, the coupled arm serves to sample the signal on the through arm. A directional coupler is capable of sampling signals propagating in two different directions. A signal flowing in a first direction on the through arm is sampled on one port of the coupled arm, while a signal flowing in the opposite direction is sampled on the other port of the coupled arm.

To measure output power or other high-power signals in a system, high-power handling capability is desirable for dual directional couplers. For example, dual directional couplers with high-power handling capabilities are well-suited to measure the output power of a base station within a cellular network. High-power directional couplers are also well-suited to measure the return loss of base station antennas by measuring both the forward power, which propagates from the base station to the antenna, and also the reverse power, which is reflected from the antenna and propagates in the opposite direction.

Traditionally, high-power directional couplers have been constructed of a number of machined metal parts. An extensive amount of labor is usually involved in assembling the large number of machined metal parts required for such high-power directional couplers. The machined metal parts taken in conjunction with the amount of labor have resulted in expensive high-power couplers on the order of several hundred dollars.

Furthermore, the final tolerances for the geometry of the coupled arms in traditional machined metal high-power couplers are relatively loose, due to the large number of separate machining and assembly steps. The resulting loose tolerances have produced relatively large performance variations amongst traditional high-power directional couplers. Therefore, many of the traditional high-power directional couplers have provided tuning slugs that can be adjusted to produce the required coupler performance. The inclusion of a tuning slug further increases the cost of these traditional machined metal high-power couplers.

High-power directional couplers are especially expensive when compared with low power couplers. Low power couplers are commonly fabricated on a dielectric printed circuit board either as microstrip or stripline designs. Microstrip coupler designs have metal plated on both the top and bottom of dielectric printed circuit board, with the top forming the arms and the bottom forming the ground plane. Stripline coupler designs have the metal arms "sandwiched" in the middle of the dielectric printed circuit board, with metal grounds on both the top and bottom of the dielectric printed circuit board. As is well known in the art, printed circuit board dielectric material costs much less than the machined metal parts and tuning slugs used in high-power couplers. In addition, fabricating couplers on printed circuit boards produces more repeatable couplers with improved performance characteristics. Therefore, coupler designers have previously considered using printed circuit board dielectric material to fabricate high-power couplers.

However, it has not proved practical to construct high-power directional couplers on printed circuit boards in microstrip or stripline configurations due to the insertion loss in the dielectric printed circuit board material. In these type of printed circuit board structures (microstrip or stripline), electric and magnetic fields necessarily penetrate the dielectric material of the printed circuit board. The dielectric material typically has inherent losses, which increases the insertion loss of the coupler. In addition, as the dielectric constant of the dielectric printed circuit board material becomes higher than that of air, the transmission lines of the through and coupled arms of the coupler become correspondingly narrowed, further increasing the insertion loss of the coupler. Therefore, in the past, printed circuit board designs have been inappropriate for high-power couplers. What is needed is a reduced cost, high-power directional coupler with improved performance characteristics as compared with machined metal high-power directional couplers.

SUMMARY OF THE INVENTION

The present invention provides a high-power directional coupler formed from a substrate, such as a printed circuit board formed of a dielectric material. The through arm and coupled arm(s) of the coupler have a conductor, typically metal, plated on the top, bottom and edges of the dielectric material. Thin non-conductive struts of the dielectric material interconnect the separate arms of the coupler. A metal package surrounding the coupler forms the outer ground.

Since the through arm has metal plated onto the edges, as well as the top and the bottom, the dielectric material is completely enclosed in metal. As a result, the RF fields flow primarily on the metal (outside of the dielectric), and generally do not penetrate into the dielectric. Therefore, the performance of the coupler is independent of the dielectric material's properties (e.g., loss tangent, dielectric constant, etc.). Thus, the coupler has a low insertion loss, enabling the coupler to operate at high-power. In addition, variations in the dielectric material's properties do not effect the performance of the coupler. Therefore, the coupler is more repeatable with improved performance characteristics. Furthermore, the independence of the dielectric material with respect to the coupler performance allows an inexpensive dielectric, e.g., FR4, to be used.

As a further advantage, fabricating high-power directional couplers out of printed circuit board material is inexpensive, compared to fabricating high-power directional couplers out of machined metal parts. For example, machined metal high-power directional couplers typically require expensive connectors and cables to connect to additional circuitry, whereas high-power directional couplers fabricating from printed circuit board material can be easily integrated with microstrip circuitry, such as switches and resistors. In addition, the number of assembly parts and processing steps are reduced by using the thin non-conductive struts of the dielectric to interconnect the separate arms of the coupler. The reduced processing steps further minimizes tolerances in fabrication geometry, and leads to more repeatable performance with no manual alignments. Furthermore, the invention provides embodiments with other features and advantages in addition to or in lieu of those discussed above. Many of these features and advantages are apparent from the description below with reference to the following drawings.

BRIEF DESCRIPTION OF THE DRAWINGS

The disclosed invention will be described with reference to the accompanying drawings, which show important sample embodiments of the invention and which are incorporated in the specification hereof by reference, wherein.

DETAILED DESCRIPTION OF THE EXEMPLARY EMBODIMENTS OF THE INVENTION

Figure 1A:
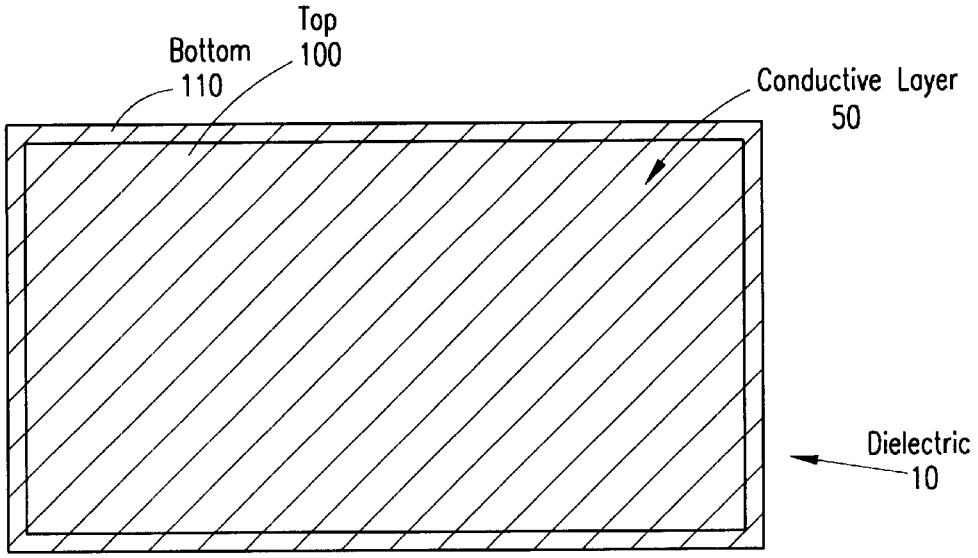
FIGS. 1A–1E are top views illustrating the fabrication of a high-power directional coupler in accordance with embodiments of the present invention.

The numerous innovative teachings of the present application will be described with particular reference to the exemplary embodiments. However, it should be understood that these embodiments provide only a few examples of the many advantageous uses of the innovative teachings herein. In general, statements made in the specification do not necessarily delimit any of the various claimed inventions. Moreover, some statements may apply to some inventive features, but not to others.

A high-power directional coupler with improved performance can be fabricated at a low cost as shown in FIGS. 1A–1E. The high-power directional coupler is capable of operating up to at least 200 watts. The center conductors, which include, e.g., the through arm 20 and coupled arm 30 shown in FIG. 1C, of the high-power directional coupler are formed from a substrate 10, such as a printed circuit board formed of dielectric material. In some embodiments, the printed circuit board 10 may have a thickness of 0.060 inches or less.

The dielectric material 10 in FIG. 1A is shown plated with a conductive layer 50, such as a layer copper, on the top 100 and bottom 110. However, it should be understood that in other high-power directional coupler fabrication processes, the dielectric material 10 may not be pre-plated with a conductive layer 50, and the fabrication process itself may include the deposition of a conductive layer 50 on the dielectric material 10, either before or after the center conductors are formed.

It should be understood that any conductive material may be used as the conductive layer 50. Examples of materials used for the conductive layer 50 include, but are not limited to, silver-plated copper, copper plating with tin/lead over the copper plating, copper plating with gold over the copper plating and copper plating with soldermask over the copper. It should be understood that soldermask is a nonconductive coating that protects copper from moisture and corrosion.

Figure 1B:
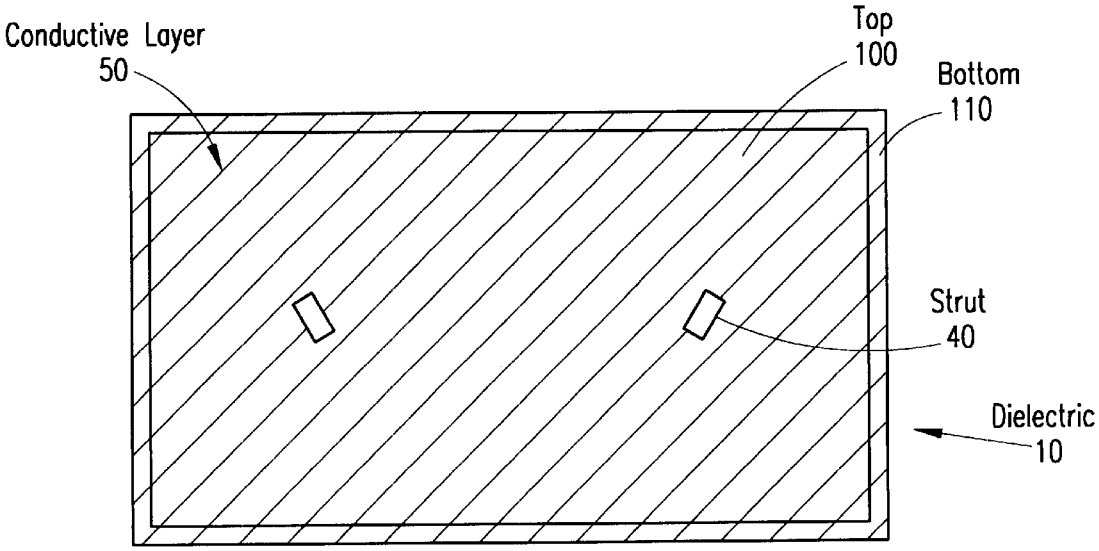

Referring now to FIG. 1B, prior to defining the through arm 20 and coupled arm 30 (shown in FIG. 1C) of the high-power directional coupler, in order to provide electrical isolation between the through arm 20 and the coupled arm 30, the conductive layer (e.g., metal) 50 is etched off, milled off or otherwise removed, from the top 100 and bottom 110 of the dielectric material 10 where narrow struts 40 will be formed.

The narrow struts 40 will serve to interconnect the arms 20 and 30. The conductive layer 50 is completely etched off of the top 100 and bottom 120 of the dielectric 10 where the struts 40 will be, so that only the non-conductive dielectric material 10 remains. Alternatively, the conductive layer 50 is etched off of the top 100, bottom 110 and edges 120 of the narrow struts 40 after the center conductors have been formed (as shown in FIG. 1C).

Figure 1C:
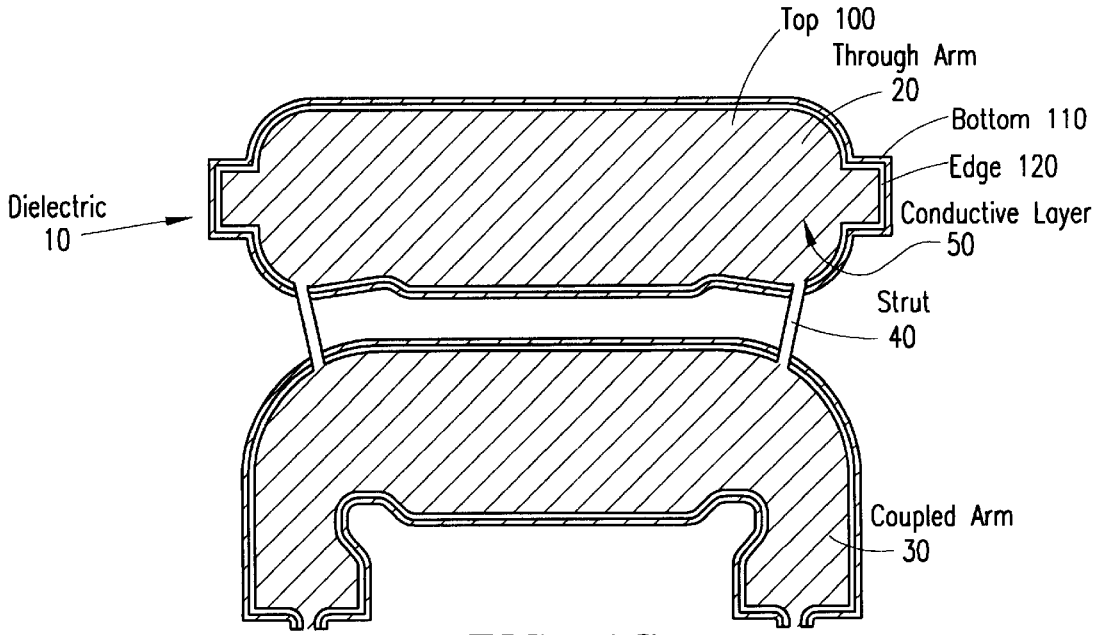

As shown in FIG. 1C, mechanically defined spacing in the dielectric material 10 forms the center conductors, e.g., the through arm 20 and coupled arm 30, of the coupler. As an example, in one embodiment, the edges 120 of the through arm 20 and coupled arm 30 are cut in a router at the same time, causing the spacing between the arms 20 and 30 to be repeatable and resulting in a uniform coupling factor between the through arm 20 and coupled arm 30.

The through arm 20 and coupled arm 30 are cut out of the dielectric printed circuit board 10 as one piece by also cutting out the narrow struts 40 interconnecting the through arm 20 and coupled arm 30. The narrow struts 40 serve as mechanical supports in addition to defining the spacing between the through arm 20 and the coupled arm 30. The narrow struts preferably have a width that is less than 10% of the coupled region length (e.g., the length of the region between the coupled arm 30 and the through arm 20 where the coupled arm 30 and through arm 20 are straight and parallel to each other). Furthermore, the narrow struts 40 are located near the edges of the arms 20 and 30 (out of the coupled region) where coupling is weakest to minimize any effects that the dielectric material's 10 properties (e.g., loss tangent and dielectric constant) may have on the RF fields produced by the arms 20 and 30. However, it should be understood that any number of struts 40 may be used, and the struts 40 may extend from any location on the arms 20 and 30. In addition, since the dielectric material 10 is nonconductive prior to plating, the coupler does not require additional non-conductive support pieces other than the struts 40 to interconnect the arms 20 and 30 and define the spacing between the arms 20 and 30.

Figure 1D:
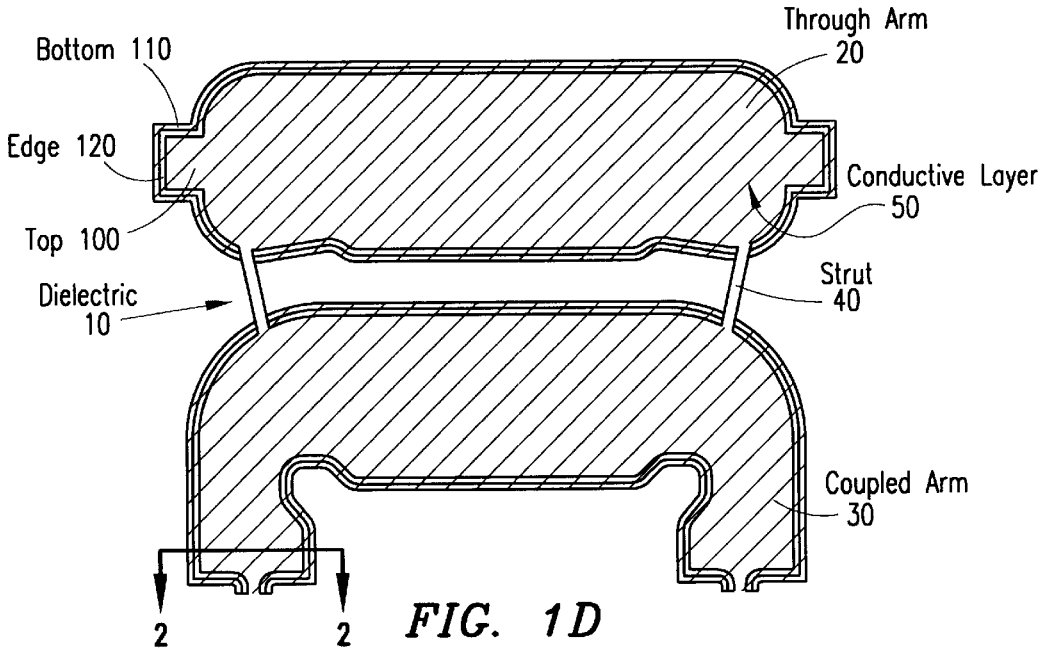

Thereafter, as shown in FIG. 1D, the edges 120 of the through arm 20 and coupled arm 30 are plated with the conductive layer 50, so that the conductive layer 50 completely encapsulates the entire cut-out piece of dielectric material 10. Since the arms 20 and 30 have the conductive layer 50 plated onto the sides 120, as well as the top 100 and the bottom 110, the dielectric material 10 forming the arms 20 and 30 is completely enclosed in the conductive layer 50. As is well-known in the art, the "skin" effect provides that RF current flows primarily on the outer surface of any conductor. Therefore, as a result of encapsulating the through arm 20 and coupled arm 30 in a conductive layer 50, the RF fields do not extend into the dielectric 10. Thus, the dielectric material's 10 properties (e.g., loss tangent and dielectric constant) do not affect the performance of the coupler.

Figure 2:
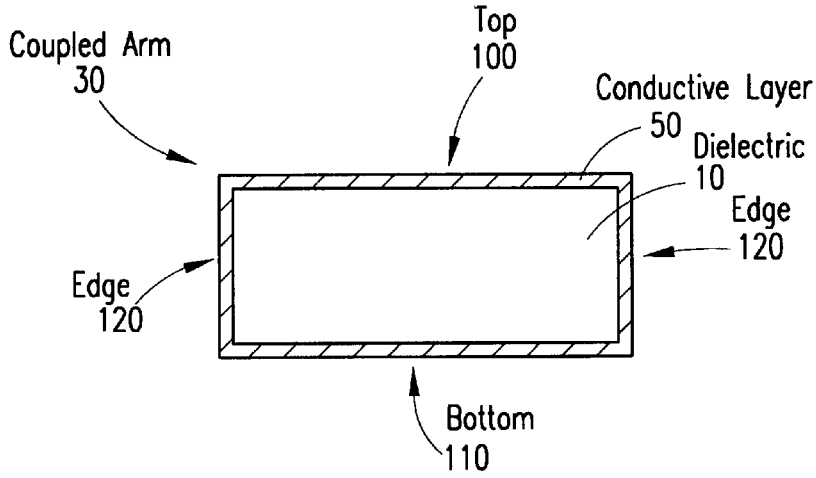
FIG. 2 is a cross-sectional view of a portion of the high-power coupler shown in FIG. 1E.

The "skin" effect can be easily seen in FIG. 2, which illustrates a cross-sectional view of the area noted in FIG. 1D. The dielectric material 10 is completely surrounded by the conductive layer 50 on the top 100, bottom 110 and edges 120 of the dielectric material 10. Therefore, the dielectric material 10 provides mechanical support for the conductive layer 50 and defines the mechanical dimensions of the arms 20 and 30.

In addition, since the performance of the coupler is independent of the dielectric material 10, the coupler is repeatable with improved performance characteristics as compared to traditional low-power printed circuit board couplers. Furthermore, the independence of the dielectric material 10 with respect to the coupler performance allows an inexpensive dielectric 10 to be used. For example, the inexpensive dielectric FR4 may be used as an alternative to an expensive dielectric, such as Duroid.

Figure 1E:
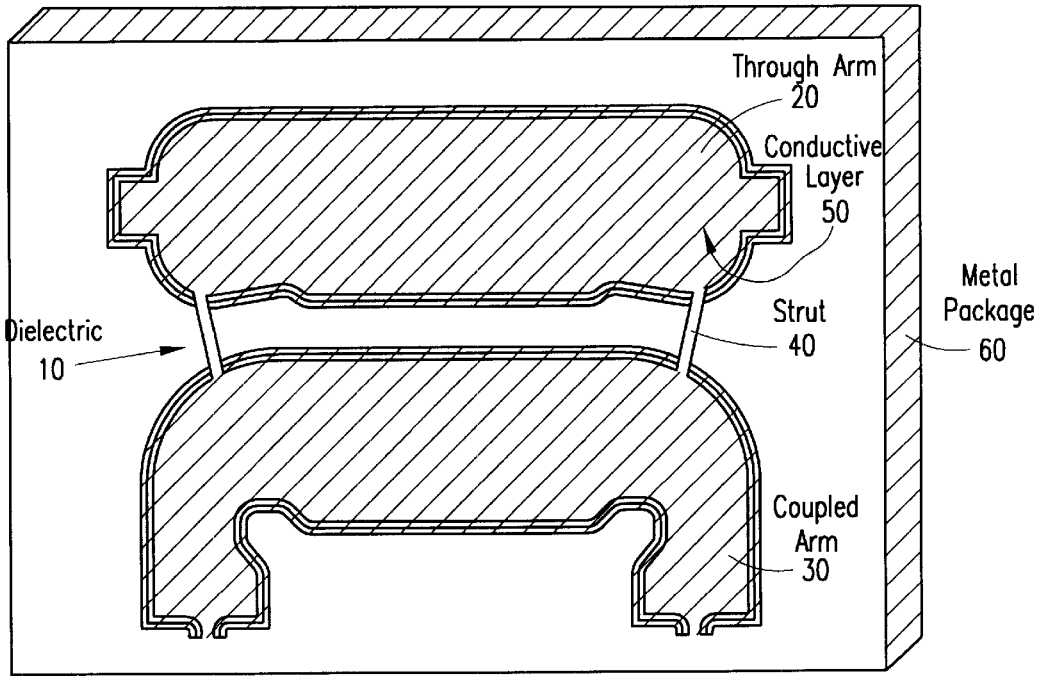
Figure 1F:
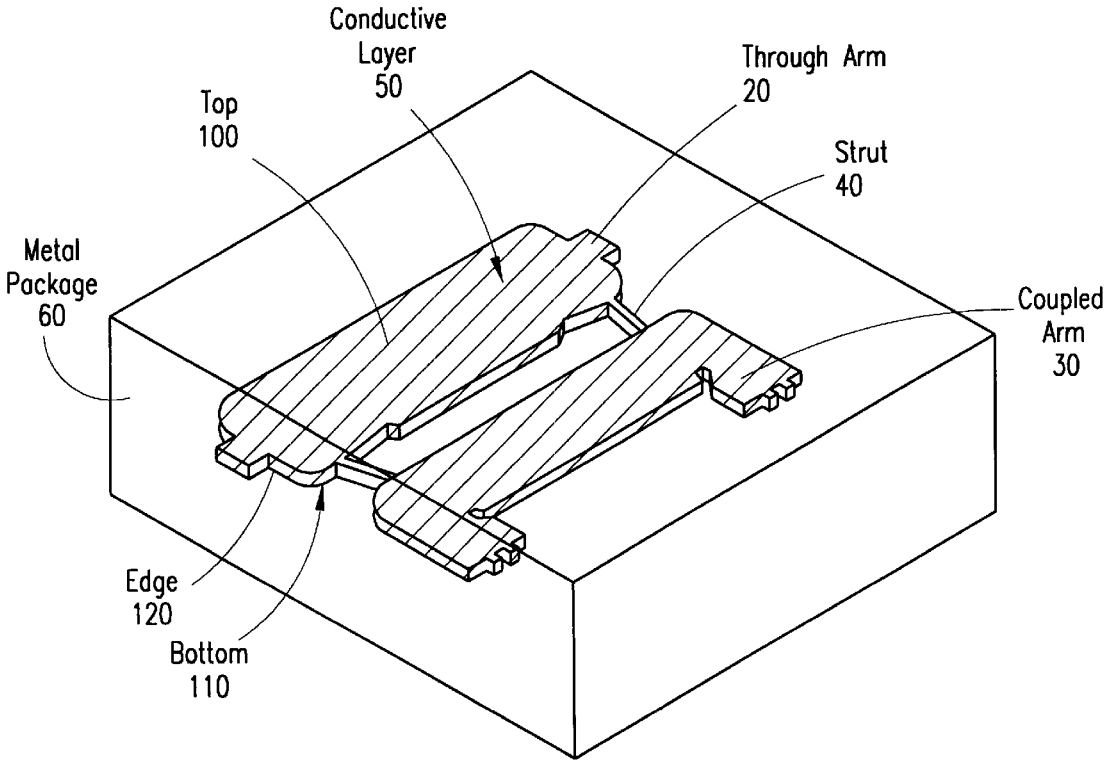
FIG. 1F is a three-dimensional view of the high-power directional coupler fabricated as shown in FIGS. 1A–1E.

Once the arms 20 and 30 and struts 40 are complete, the center conductors of the coupler are placed in a metal package 60, as shown in FIG. 1E. The package 60 forms the outer ground of the coupler. The metal package 60 behaves in a similar manner to the outer metal jacket of a coaxial cable. As is understood in the art, in a coaxial cable, the outer metal jacket functions as a ground to the center conductor. Likewise, the outer metal package 60 of the coupler functions as a ground to the arms 20 and 30 of the coupler. A three-dimensional view of the coupler is shown in FIG. 1F to illustrate the center conductors 20 and 30 within the metal package 60.

Figure 3:
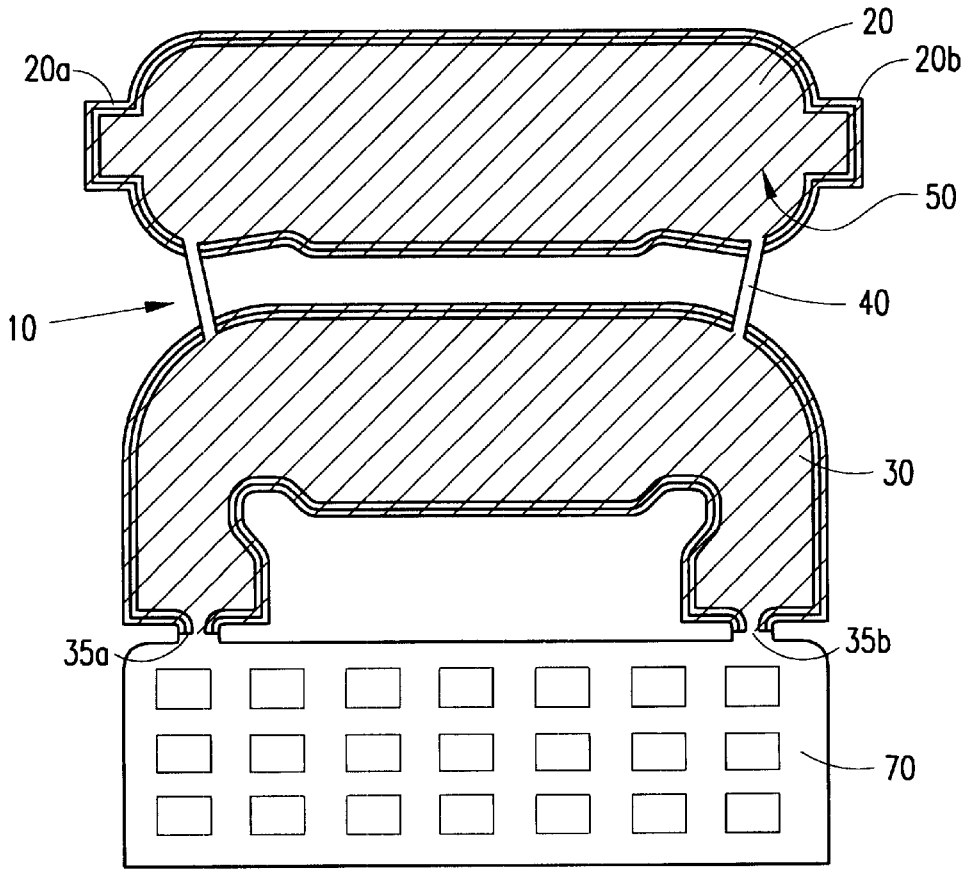
FIG. 3 is a top view of a high-power coupler integrated with microstrip circuitry, in accordance with embodiments of the present invention.

Referring now to FIG. 3, even though the high-power directional coupler is effectively an air-dielectric slabline, since the coupler is fabricated from a printed circuit board 10, the coupler can easily be integrated with microstrip circuitry 70, such as switches, resistors, etc. A signal entering at the left 20*a* of the through arm 20 is coupled to the left port 35*a* of the coupled arm 30 and output to the circuitry 70 to process the signal. Likewise, a signal entering at the right 20*b* of the through arm 20 is coupled to the right port 35*b* of the coupled arm 30 and output to the circuitry 70 to process the signal. Switches may be used to switch between the left and right ports 35*a* and 35*b*, respectively, to sample signals entering at the left 20*a* or right 20*b* of the through arm 20 separately.

Machined metal couplers typically required coaxial cables to interface to such circuitry, adding to the cost. However, by fabricating the coupler on a printed circuit board 10, the output of the coupled arm 30 can be directly electrically connected to the circuitry 70. Therefore, the dielectric coupler requires fewer parts, which results in a lower cost, as compared with machined metal couplers.

In addition, by fabricating the high-power coupler out of a single monolithic substrate 10, the insertion loss can be kept to about 0.1 dB, thereby producing an acceptable power dissipation. For example, with a 200 watt signal and 0.1 dB insertion loss, approximately 4.6 watts would be dissipated in the coupler. The temperature rise produced by the 4.6 watt power dissipation is acceptable for electronic components integrated with the coupler. Therefore, the low insertion loss produced by the dielectric coupler allows the coupler to handle high power levels without placing undue thermal stress on the electronic components.

Figure 4:
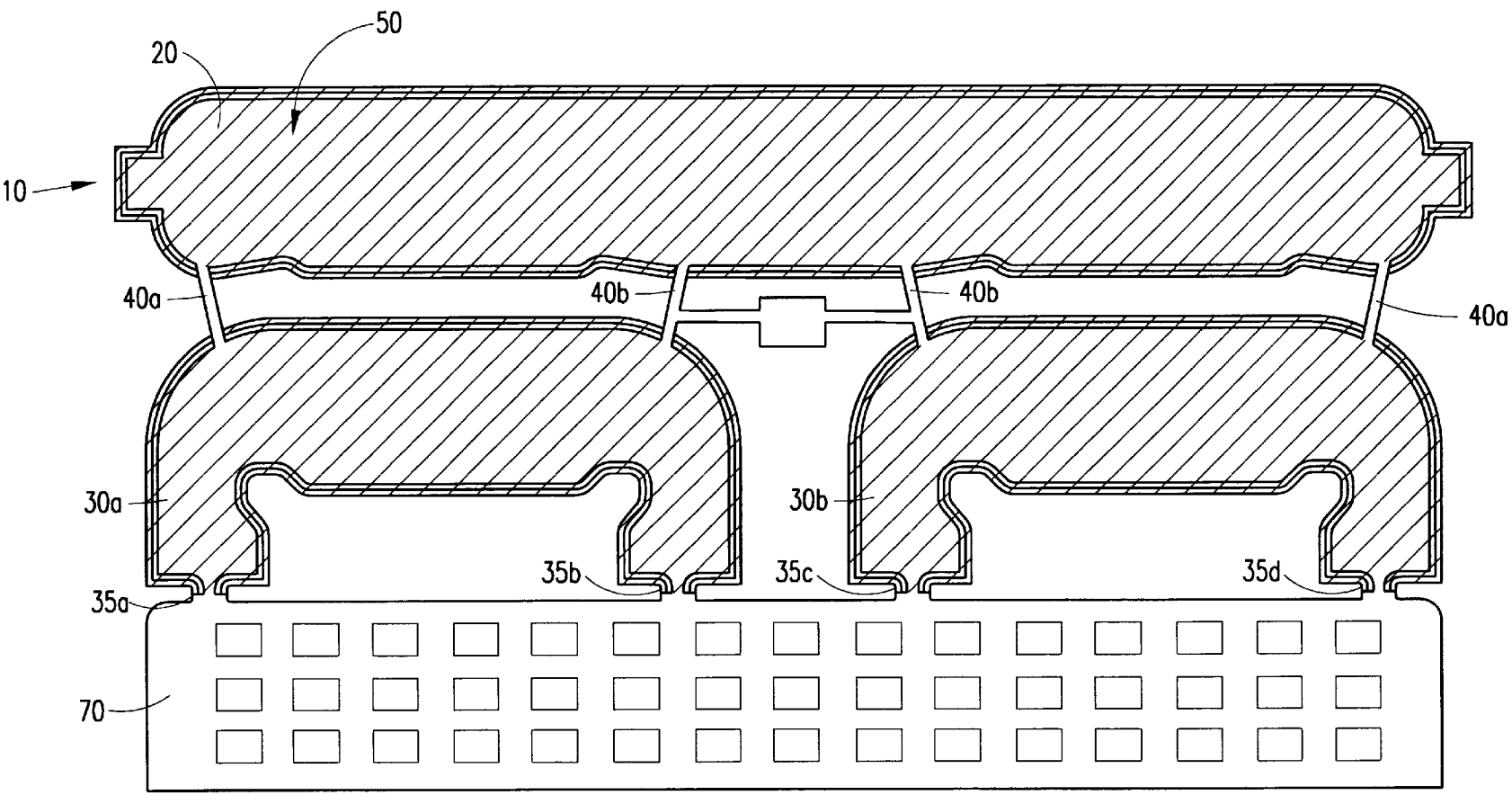
FIG. 4 is a top view of a high-power directional coupler integrated with microstrip circuitry in accordance with embodiments of the present invention.

As shown in FIG. 4, a high-power dual directional coupler can also be fabricated on a printed circuit board 10, as discussed above in connection with FIGS. 1A–1F. A high-power dual directional coupler includes two coupled arms 30*a* and 30*b* to provide four output ports 35*a–d*, enabling multiple devices to be connected to the coupler. The directivity of the high-power dual directional coupler is enhanced relative to a low-power printed circuit board coupler by fabricating the dual directional coupler on a printed circuit board 10, due to the fact that all of the RF fields are in a completely homogenous dielectric. In addition, as discussed above, use of a printed circuit board 10 also enables easy integration of the dual directional coupler with circuitry 70, as is shown.

The dual directional coupler also has struts 40*a–c* interconnecting the through arm 20 to both of the coupled arms 30*a* and 30*b*. Each coupled arm 30*a* and 30*b* is shown having an outer strut 40*a* and an inner strut 40*b*, both extending from near the corners of the coupled arm 30*a* and 30*b*. In addition, a reinforced strut 40*c* is shown interconnecting the inner struts 40*b* of the two coupled arms 30*a* and 30*b*. However, it should be understood that any number of struts 40*a–c* may be used, and the struts 40*a–c* may extend from any location on the arms 20 and 30. As before, the narrow struts 40*a–c* serve as mechanical supports to define the spacing between the through arm 20 and the coupled arms 30*a* and 30*b*. Furthermore, since the narrow struts 40*a–c* are located near the edges of the coupled arms 30*a* and 30*b* where coupling is weakest, the struts 40*a–c* produce minimal (if any) effect on the RF fields produced by the coupled arms 30*a* and 30*b*.

As will be recognized by those skilled in the art, the innovative concepts described in the present application can be modified and varied over a wide range of applications. Accordingly, the scope of patented subject matter should not be limited to any of the specific exemplary teachings discussed, but is instead defined by the following claims.

I claim:

1. A high-power directional coupler, comprising:

a substrate having mechanically defined spacing to form a through arm and at least one coupled arm, said through arm and said at least one coupled arm each having a top face, a bottom face and edges; and a conductive layer encapsulating said through arm and said at least one coupled arm, said conductive layer extending along said top face, said bottom face and said edges of both said through arm and said at least one coupled arm.

2. The coupler of claim 1, further comprising:

a metal package surrounding said encapsulated through arm and said at least one encapsulated coupled arm to form an outer ground of said coupler.

3. The coupler of claim 1, wherein said conductive layer includes a layer of copper.

4. The coupler of claim 1, wherein said through arm and said at least one coupled arm are interconnected by at least one insulating strut of said substrate extending between said through arm and said coupled arm.

5. The coupler of claim 4, wherein said at least one strut includes first and second struts positioned distally from each other, said first strut extending from near an end of said through arm, said second strut extending from near an end of said coupled arm.

6. The coupler of claim 4, wherein said at least one coupled arm includes first and second coupled arms to form a dual directional coupler.

7. The coupler of claim 6, wherein said at least one strut includes first and second struts, said first strut interconnecting said first coupled arm and said through arm and said second strut interconnecting said second coupled arm and said through arm.

8. The coupler of claim 7, wherein said substrate further comprises at least one reinforced strut extending between said first and second struts.

9. The coupler of claim 1, wherein said substrate is formed of a dielectric material.

10. The coupler of claim 9, wherein said substrate is a printed circuit board formed of said dielectric material.

11. A method for fabricating a high-power directional coupler, comprising:

mechanically defining spacing on a substrate to form a through arm and at least one coupled arm, said through arm and said at least one coupled arm each having a top face, a bottom face and edges; and encapsulating said through arm and said at least one coupled arm in a conductive layer, said conductive layer extending along said top face, said bottom face and said edges of both said through arm and said at least one coupled arm.

12. The method of claim 11, further comprising:

providing a metal package surrounding said encapsulated through arm and said at least one encapsulated coupled arm to form an outer ground of said coupler.

13. The method of claim 11, wherein said step of mechanically defining further comprises:

mechanically defining at least one insulating strut of said substrate extending between said through arm and said coupled arm, said conductive layer being etched off of said at least one strut.

14. The method of claim 13, wherein said step of mechanically defining spacing further comprises:

mechanically defining on said substrate first and second struts positioned distally from each other, said first strut extending from near an end of said through arm and said second strut extending from near an end of said coupled arm.

15. The method of claim 13, wherein said step of mechanically defining spacing further comprises:

mechanically defining on said substrate first and second coupled arms to form a dual directional coupler.

16. The method of claim 15, wherein said step of mechanically defining spacing further comprises:

mechanically defining on said substrate first and second struts, said first strut interconnecting said first coupled arm and said through arm and said second strut interconnecting said second coupled arm and said through arm.

17. The method of claim 16, wherein said step of mechanically defining spacing further comprises:

mechanically defining on said substrate at least one reinforced strut extending between said first and second struts.

18. The method of claim 11, further comprising:

providing said substrate, said substrate being formed of a dielectric material.

19. The method of claim 18, wherein said step of providing further comprises:

providing said substrate, said substrate being a printed circuit board formed of said dielectric material.

20. The coupler of claim 19, further comprising:

electrically connecting the output of said at least one coupled arm directly to circuitry.

* * * * *